US009777560B2

(12) United States Patent
Tetzlaff et al.

(10) Patent No.: US 9,777,560 B2
(45) Date of Patent: Oct. 3, 2017

(54) AUXILIARY FACE SEAL FOR SUBMERSIBLE WELL PUMP SEAL SECTION

(71) Applicant: Baker Hughes Incorporated, Houston, TX (US)

(72) Inventors: Steven K. Tetzlaff, Owasso, OK (US); Lance T. Robinson, Tulsa, OK (US); Kevin R. Bierig, Tulsa, OK (US); Daniel A. Shaffer, Talala, OK (US)

(73) Assignee: Baker Hughes Incorporated, Houston, TX (US)

( * ) Notice: Subject to any disclaimer, the term of this patent is extended or adjusted under 35 U.S.C. 154(b) by 364 days.

(21) Appl. No.: 14/548,945

(22) Filed: Nov. 20, 2014

(65) Prior Publication Data

US 2016/0145984 A1 May 26, 2016

(51) Int. Cl.
*F04D 13/10* (2006.01)
*E21B 43/12* (2006.01)
*F04D 29/12* (2006.01)

(52) U.S. Cl.
CPC ..... *E21B 43/128* (2013.01); *F04D 13/10* (2013.01); *F04D 29/126* (2013.01)

(58) Field of Classification Search
CPC ..... F04D 13/10; F04D 29/086; F04D 29/10; F04D 29/106; F04D 29/12; F04D 29/126
See application file for complete search history.

(56) References Cited

U.S. PATENT DOCUMENTS 4,421,999 A * 12/1983 Beavers ..... F04D 13/10 310/87
5,367,214 A * 11/1994 Turner, Jr. ..... F04B 43/082 310/87
6,688,860 B2 * 2/2004 Du ..... E21B 43/128 310/87
7,530,391 B2 5/2009 Hall et al.
7,654,315 B2 * 2/2010 Du ..... E21B 4/003 166/105
8,221,092 B2 7/2012 Chilcoat et al.
8,830,471 B2 * 9/2014 Wilson ..... G01D 5/35316 356/32
8,845,308 B2 * 9/2014 Tetzlaff ..... F04D 29/0476 417/423.11
2007/0140876 A1 * 6/2007 Parmeter ..... F04D 13/10 417/423.11
2008/0078560 A1 4/2008 Hall
2013/0004344 A1 1/2013 McKinney et al.
2014/0202681 A1 * 7/2014 Merrill ..... E21B 43/128 166/105

* cited by examiner

*Primary Examiner* — Patrick Hamo
(74) *Attorney, Agent, or Firm* — Bracewell LLP; James E. Bradley

(57) ABSTRACT

A well fluid submersible pump assembly includes a pump operatively coupled to a motor and a seal section located between the motor and the pump. The seal section has a single piece tubular housing with adapters secured to opposite ends of the housing. A shaft extends axially through the housing for driving the pump. An auxiliary seal carrier located in the housing has a central bore through which the shaft extends and has an outer diameter portion that seals to the bore of the housing. Opposed check valves in the seal carrier allow lubricant to flow from one side of the auxiliary carrier to an opposite side of the seal carrier in response to a selected pressure differential. A mechanical face seal mounts to the auxiliary seal carrier and seals around the shaft.

13 Claims, 4 Drawing Sheets

AUXILIARY FACE SEAL FOR SUBMERSIBLE WELL PUMP SEAL SECTION

FIELD OF THE DISCLOSURE

This disclosure relates in general to submersible well fluid pumps and in particular to a seal section for sealing motor lubricant that has an auxiliary mechanical face seal located entirely within the housing of the seal section.

BACKGROUND OF THE DISCLOSURE

Electrical submersible pumps (ESP) are often employed to pump well fluid from wells. A typical ESP includes a rotary pump driven by an electrical motor. Normally, the ESP is suspended in the well on a string of production tubing. A drive shaft assembly extends from the motor through a seal section and into the pump for driving the pump. The motor and at least part of the seal section are filled with a dielectric motor lubricant.

The seal section has a main seal that seals around the shaft, sealing well fluid on the exterior from the motor lubricant. Normally, the main seal is a mechanical face seal having a rotating member that rotates against a stationary member. Mechanical face seals of this type are durable and work well, but they weep a small amount depending on the matrix of the well fluids, such as the presence of solids, sand or scale, which can degrade the sealing interface over time. The entry of well fluid past the main seal allows well fluid to come into contact with the motor lubricant. Seal sections may also have a secondary mechanical face seal at the end facing the motor.

One type of seal section has a labyrinth arrangement that creates a serpentine flow path for fluid to flow from the pump end to the motor end. U.S. Pat. No. 8,845,308 discloses a labyrinth type seal section particularly for use in horizontal sections of wells. A number of discs are disposed within the seal section housing. Each disc has a communication port extending through it. The discs are oriented with the communication ports at different angular locations. When the ESP is operated horizontally, some of the communication ports will be at different elevations than others. Water within the encroaching well fluid tends to accumulate in the lower portions of the housing between the discs. The higher and lower communication ports inhibits the migration of water horizontally from the pump end to the motor end of the seal section.

Another type of labyrinth seal section is intended particularly for vertical orientations of the ESP and comprises at least one downward extending flow tube with a lower outlet in the chamber and at least one upward extending flow tube with an upper outlet in the chamber. Any well fluid leakage has to flow down the downward extending flow tube, then back up the upward. The well fluid and the motor lubricant may have a contacting interface, such that hydrostatic pressure from the well bore fluid is applied to the motor lubricant to equalize with the hydrostatic pressure of the well fluid on the exterior of the ESP.

Some types of seal section also have pressure equalizing components, such as a flexible bag or bellows. The bag or bellows has motor lubricant on one side and well fluid on another side. Seal sections with pressure equalizing components may also have some type of labyrinth arrangement. Also, a separate pressure equalizing unit may be attached to the end of the motor opposite the seal section. Seal sections may also include a thrust bearing unit for absorbing thrust on the drive shaft.

The various types of seal sections typically employ a main seal of a type that can weep in the event the sealing surface begins to degrade, as mentioned above. It is known to add a second mechanical face seal to the seal section for redundancy. However, the seal section would normally need extensive re-design to locate the second mechanical face seal. It is also known to add an additional seal section in tandem, the additional seal section having a second mechanical face seal. A second seal section in tandem adds to the cost of the ESP significantly and may increase the horsepower requirements of the motor.

SUMMARY

The ESP of this disclosure has a seal section located between a motor and a pump. The seal section has a motor end adapter for operatively connecting to the motor and a pump end adapter for operatively connecting to the pump. A housing has one end secured to the pump end adapter and another end secured to the motor end adapter. The housing is in fluid communication with lubricant in the motor via the motor end adapter. A drive shaft driven by the motor extends axially through the seal section for driving the pump. A main seal seals around the shaft at the pump end adapter. An auxiliary seal carrier is entirely located within the housing, the seal carrier having a bore through which the shaft extends and a cylindrical outer diameter portion. The seal carrier has a maximum outer diameter less than a minimum inner diameter of the housing. An outer diameter seal seals between the outer diameter portion of the seal carrier and the inner diameter of the housing. A check valve in the seal carrier allows lubricant to flow from one side of the seal carrier to an opposite side of the seal carrier in response to a selected pressure differential. A mechanical face seal is mounted in the bore of the seal carrier and in engagement with the shaft. The face seal has one side exposed to motor lubricant in the housing on the pump side of the seal carrier and another side exposed to motor lubricant in the housing on the motor side of the seal carrier.

An additional check valve may be located in the seal carrier to allow lubricant in the housing to pass through the seal carrier in an opposite direction from the first mentioned check valve in response to a selected pressure differential.

The seal carrier preferably has a central portion extending radially outward from the bore to the outer diameter portion. The outer diameter portion has a greater axial dimension that the any part of the central portion, defining a central cavity on one of the sides of the seal carrier. The check valve may be located in a check valve port extending through the central portion.

An axially extending anti rotation pin is in engagement with a hole formed in one of the sides of the seal carrier to prevent rotation of the seal carrier within the housing. The mechanical face seal is preferably located on the pump side of the seal carrier.

A labyrinth disc may be mounted entirely within the housing adjacent to the seal carrier. The disc has a central bore through which the shaft passes. The disc has a maximum outer diameter portion with an outer diameter substantially the same as the maximum outer diameter portion of the seal carrier. A disc outer diameter seal seals between the outer diameter portion of the disc and the interior surface of the housing. A disc shaft seal in the bore of the disc seals around the shaft. A communication port extends through the disc from a motor side of the disc to a pump side of the disc, enabling motor lubricant in the housing to flow through the communication port between the motor side and the pump side of the disc. Labyrinth discs may be located on both sides of the auxiliary seal carrier. The outer diameter portion of each of the discs has a same axial length as the outer diameter portion of the auxiliary seal carrier, enabling the auxiliary seal carrier to be installed in the housing in place of any one of the discs.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
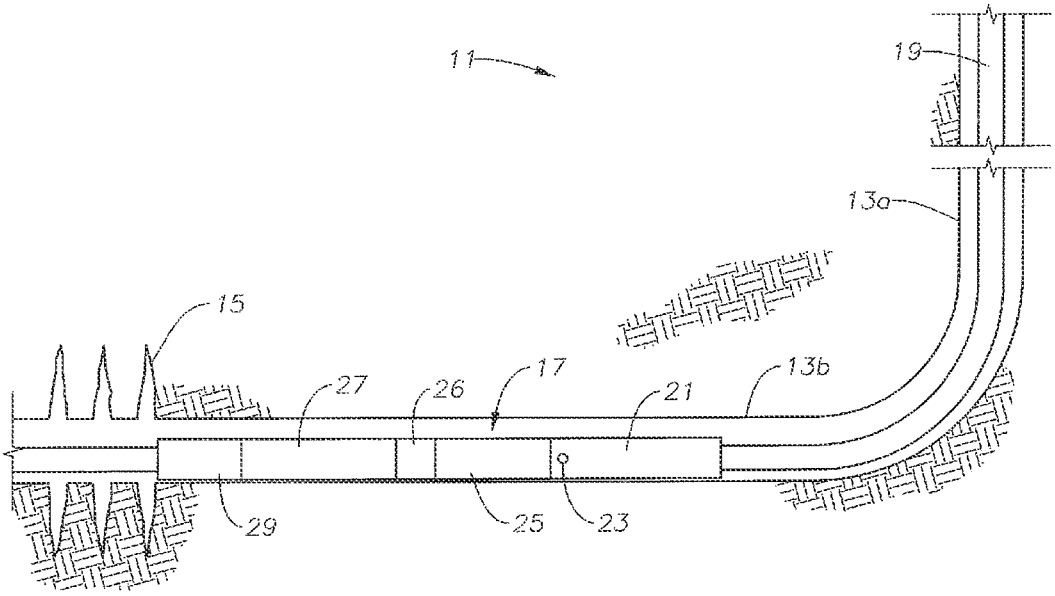
FIG. 1 is a schematic side view of an electrical submersible pump assembly in accordance with this disclosure and installed with a horizontal section of a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, in this example, well 11 has a casing with an upper vertical portion 13*a* that curves into a lower inclined portion 13*b*, which may be horizontal. Inclined portion 13*b* has a set of perforations 15 or other openings to allow the flow of formation fluid into casing 11. An ESP 17 within inclined portion 13*b* pumps well fluid flowing in perforations 15 up a string of production tubing 19 to a wellhead at the surface.

ESP 17 has a pump 21 with an intake 23 for drawing in well fluid. Pump 21 may be a rotary pump, such as a centrifugal pump or a progressing cavity pump; or pump 21 may be another type. A seal section 25 connects to intake 23. If a gas separator (not shown) is employed to separate gas from the well fluid before reaching pump 21, intake 23 would be in the gas separator, not at the end of pump 21. A thrust bearing unit 26 is located at a motor end of seal section 25 in this example, and may be considered to be a part of seal section 25.

A motor 27 for driving pump 21 connects to thrust bearing unit 26. Motor 27 is typically a three-phase electrical motor filled with a dielectric motor lubricant. A pressure equalizer 29 at the opposite end of motor 27 has a movable element to reduce a pressure differential between the hydrostatic pressure of the well fluid surrounding motor 27 and the motor lubricant in motor 27. Pressure equalizer 29 normally has a flexible bag or bellows. The motor lubricant in motor 27 communicates with motor lubricant in thrust bearing unit 26 and seal section 25. A drive shaft assembly of motor 27 extends through thrust bearing unit 26, seal section 25, and into pump 21 to drive pump 21. Seal section 25 seals around the drive shaft assembly, preventing well fluid from entering motor 27. The various connections between pump 21, seal section 25, thrust bearing unit 26, motor 27 and equalizer 29 may be either threaded collar or bolted connections.

Figure 2A:
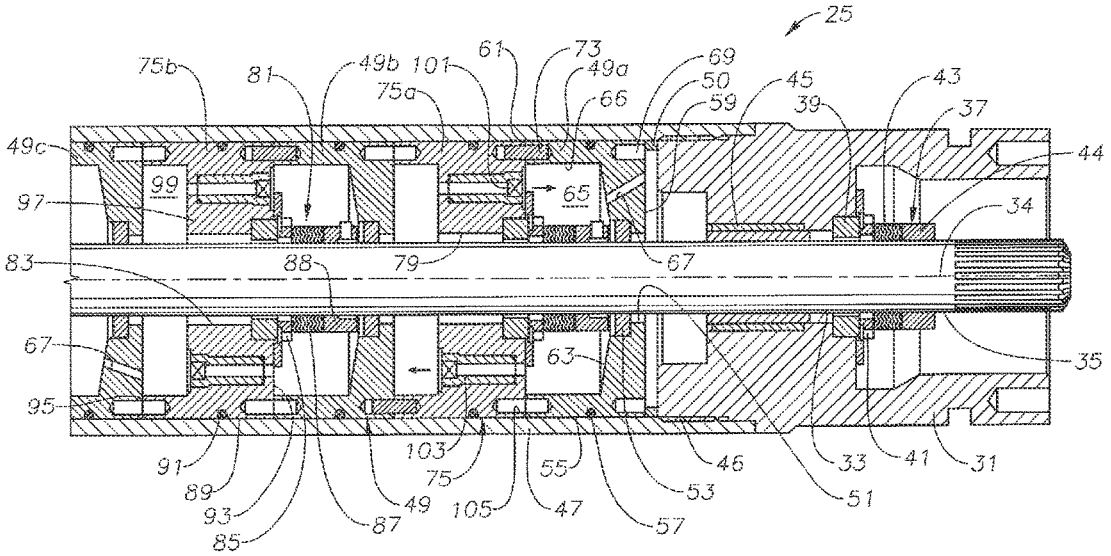
FIGS. 2A and 2B comprise a sectional view of the seal section of the pump assembly of FIG. 1.

Referring to FIG. 2A, seal section 25 has a guide or pump end adapter 31 on one end for connecting to pump intake 23. Pump end adapter 31 is a short tubular member having a bore 33 located on a longitudinal axis 34 of seal section 25. A drive shaft 35, which is one part of the drive shaft assembly between motor 27 and pump 21 (FIG. 1), extends through bore 33. A main seal 37 is located on the pump side of pump end adapter 31 for sealing around shaft 35. Main seal 37 is normally a mechanical face seal having a non rotating base 39 mounted in bore 33. A rotating member 41 rotates with shaft 35 and is in rotating sliding and sealing engagement with base 39. A boot 43, which may be a bellows, extends between rotating member 41 and a fastener ring 44 that secures to shaft 35. Fastener ring 44 and the exterior of boot 43 are immersed in well fluid. The interior of boot 43 is in contact with motor lubricant in seal section 25.

A bearing 45 in bore 33 provides radial support for shaft 35 but does not seal. Pump end adapter 31 has external threads 46 that secure to a cylindrical housing 47 of seal section 25. Housing 47 is a single-piece member in this embodiment.

In this embodiment, a number of labyrinth discs 49 are located entirely within housing 47. As an example, four are shown and indicated with the numerals 49*a*, 49*b*, 49*c* and 49*d*. Disc 49*a* is the closest to pump end adapter 31. A compression ring or spacer 50 fills an axial space between disc 49*a* and pump end adapter 31 to prevent axial movement of discs 49 in housing 47. Each disc 49 has a central bore 51 on axis 34. Each bore 51 has a seal 53, which may be a lip seal, that seals between shaft 35 and one of the discs 49. The lip of each seal 53 preferably extends or points toward pump end adapter 31. Each disc 49 has an outer diameter portion 55 that is only slightly less than the inner diameter of housing 47. An outer diameter seal 57 seals to the interior surface of the housing 47. Each disc 49 has a pump facing side 59 and a motor facing side 61, A central portion 63 of each disc 49 has a lesser axial thickness than outer diameter portion 55, defining a central cylindrical cavity 65 that is located on the motor facing side 61 in this embodiment. Cavity 65 defines an inward-facing cylindrical wall 66 of outer diameter portion 55. The radial dimension of outer diameter portion 55 from inward facing wall 66 to the outer diameter of outer diameter portion 55 is less than the radial dimension of cavity 65. Central portion 63 may have a concave surface, as shown.

A communication port 67 extends through each disc 49 from pump facing side 59 to motor facing side 61. Communication ports 67 are skewed relative to axis 34 in this example. Discs 49 are oriented 90 degrees relative to adjacent discs 49, but the angular difference could be other than 90 degrees. When oriented in the particular horizontal orientation shown in FIGS. 2A and 2B, communication port 67 of first disc 49*a* is at a highest elevation or distance from the low side of housing 47. Communication port 67 of second disc 49*b* isn't visible in FIG. 2A because it is 90 degrees relative to communication port 67 of first disc 49*a* in this example. Communication port 67 of second disc 49*b* would be at a lesser distance from the low side of housing 47. Communication port 67 of third disc 49*c* would be on the low side and lower than the communication ports 67 in discs 49*a* and 49*b*. Communication port 67 of fourth disc 49*d* (FIG. 2B) would not be visible in this view because it would be 90 degrees relative to communication ports 67 in first disc 49*a* and third disc 49*c*.

The staggering of communication ports 67 creates a serpentine or tortuous flow path for encroaching well fluid to migrate from pump end to the motor end of housing 47. Water in the encroaching well fluid is denser than the oil, thus would tend to accumulate in the lower portions of the spaces between discs 49. The water would have to flow upward in housing 47 to reach the higher elevation communication ports 67, assuming it is horizontal, thus retarding the migration of water in a direction toward motor 27 (FIG. 1). Normally, an operator will not know which side of housing 47 ends up being on the low side, thus communication port 67 of first disc 49*a* or of any other disc 49, could end up being at the highest elevation or lowest distance from the low side.

One or more anti-rotation holes 69 are located on disc pump facing side 59 and also on disc motor facing side 69, preferably near the outer diameter of outer diameter portion 55. Anti-rotation holes 69 extend parallel to axis 34 and align with anti-rotation holes 69 of adjacent discs 49. Anti-rotation pins 73 extend between aligned anti-rotation holes 69.

At least one auxiliary seal assembly 75 mounts within housing 47, and two auxiliary seal assemblies 75*a*, 75*b* are shown in this embodiment. Auxiliary seal assembly 75*a* is located between discs 49*a* and 49*b*. Auxiliary seal assembly 75 *b* is located between discs 49*b* and 49*c*. In many cases, one auxiliary seal assembly 75 is adequate, and it can be located anywhere within housing 47. Auxiliary seal assemblies 75*a*, 75*b* may be identical to each other.

Figure 3:
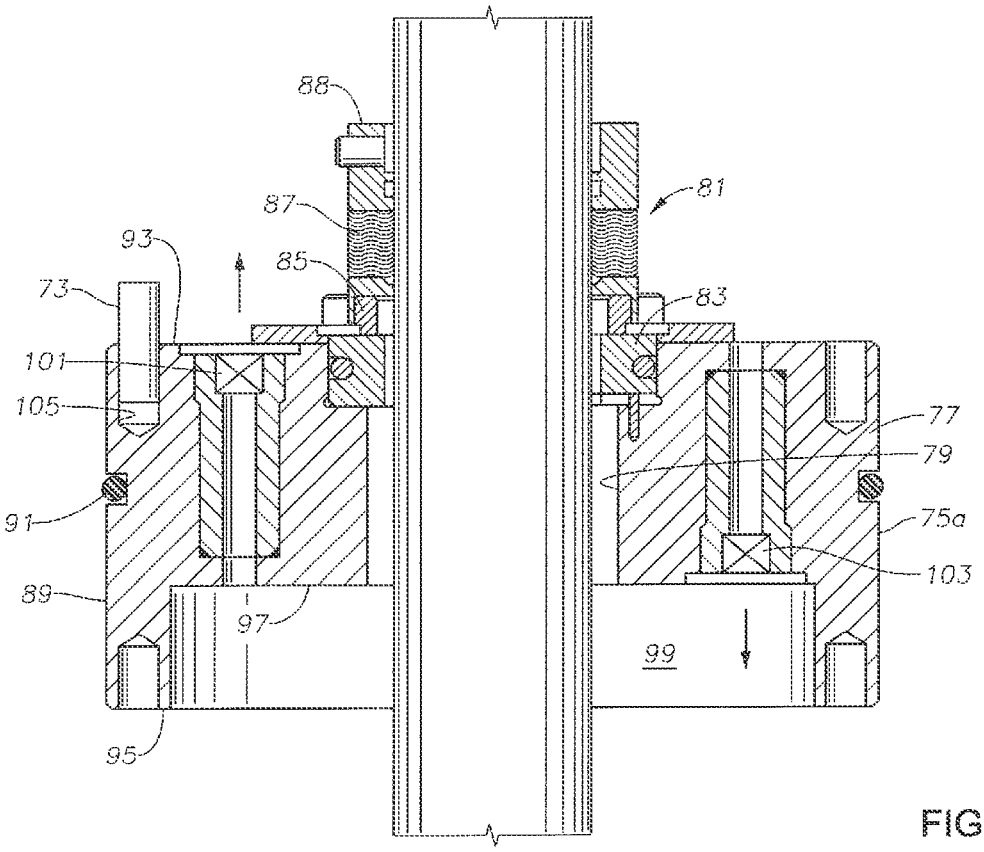
FIG. 3 is an enlarged sectional view of one of the auxiliary face seals of the seal section of FIGS. 2A and 2B shown removed from the seal section.

Referring also to FIG. 3, auxiliary seal assembly 75*a* includes an auxiliary seal carrier 77, which is a cylindrical body having a central bore 79 coaxial with axis 34 through which shaft 35 extends. A mechanical face auxiliary seal 81 mounts to auxiliary seal carrier 77 and seals around shaft 35. Auxiliary seal 81 has the same structure as main seal 37 and may be identical. Auxiliary seal 81 has a base 83 fixed to auxiliary seal carrier 77 and a rotating member 85 that sealingly and slidingly engages base 83. A boot 87 extends between a shaft fastener ring 88 and rotating member 85. Fastener ring 88 may protrude into the concave portion of motor facing side 61 of the adjacent disc 49*a* (FIG. 2A).

Auxiliary seal carrier 77 has an outer diameter portion 89 that has the same outer diameter as discs 49. An outer diameter seal 91 seals outer diameter portion 89 to the interior surface of housing 47. Auxiliary seal carrier 77 has a pump facing side 93 and motor facing side 95. A central portion 97 is of lesser axial thickness, defining a cavity 99 on motor facing side 95. Auxiliary seal 81 is preferably located on pump facing side 93 and will be spaced closely to but not touching lip seal 53 of the adjacent disc 49*a* (FIG. 2A) on the pump facing side 93.

A first check valve 101 and a second check valve 103 are located in passages in auxiliary seal carrier 77 extending between pump facing side 93 and motor facing side 95. Check valve 103 opens to allow lubricant to flow from pump facing side 93 to motor facing side 95, as indicated by the arrow, when auxiliary seal carrier 77 experiences a selected level of pressure on pump facing side 93 greater than motor facing side 95. Similarly, check valve 101 opens to allow lubricant to flow from motor facing side 95 to pump facing side 93, as indicated by the arrow, when the pressure on motor facing side 95 is greater than the pressure on pump facing side 93 by a selected amount. The selected pressure differences between check valve 101 and check valve 103 can differ, the overall purpose being to allow pressure equalization throughout the portion of housing 47 containing auxiliary seal 81 is located.

Auxiliary seal carrier 77 has anti-rotation holes 105 on both its pump facing side 93 and motor facing side 95 adjacent outer diameter portion 89. Anti-rotation pins 73 will extend between anti-rotation holes 105 and anti-rotation holes 69 in adjacent discs 49*a* and 49*b* (FIG. 2A) to prevent relative rotation. More specifically, one of the anti-rotation pins 73 extends from one of the holes 105 on pump facing side 93 into one of the holes 69 of disc 49*a* (FIG. 2A). Another anti-rotation pin 73 extends from one of the holes 105 on motor facing side 95 into a mating hole 69 of disc 49*b*.

Referring again to FIG. 2A, outer diameter portion 89 of auxiliary seal carrier 77 has the same axial length as outer diameter portion 55 of each disc 49. That is, the distance from pump facing side 93 to motor facing side 95 of outer diameter portion 89 is the same as the distance from pump facing side 59 to motor facing side 61 of each disc 49. Consequently, auxiliary seal assembly 75 can be interposed anywhere within a stack of discs 49, simply by inserting auxiliary seal assembly 75 in a place that could alternately accommodate one of the discs 49. For example, second auxiliary seal assembly 75*b* could be replaced by one of the discs 49 simply by interchanging them.

A guide or motor end adapter 107 secures to the end of housing 47 closest to motor 27 (FIG. 1) with threads 109. All of the discs 49 and auxiliary seal assemblies 75*a* and 75*b* are in axial abutment with each other and retained in housing 47 by adapters 31 and 107. Motor end adapter 107 has an anti-rotation hole on its pump facing side that receives one of the anti-rotation pins 73. Because anti-rotation pins 73 interlock each of the discs 49 and each seal assembly 75*a*, 75*b* in the stack, motor end adapter 107 prevents the stack from rotation relative to housing 47. Motor end adapter 107 is a short tubular member having a central bore 111 through which shaft 35 extends. A motor end seal 113 seals around shaft 35 at bore 111. Motor end seal 113 is also a mechanical face seal and may be identical to main seal 37 (FIG. 2A). Motor end seal 113 is located on the pump facing side of motor end adapter 107 and will have motor lubricant on both sides.

A radial bearing 115 in bore 111 radially stabilizes shaft 35 but does not seal. An axially extending check valve port 117 in motor end adapter 107 contains a check valve 119. A lateral port 121 extending from port 117 to the exterior will contain a plug (not shown) while in operation. Another check valve port arrangement 123 contains a check valve 125. A lateral port 126 extending from check valve port 123 to the exterior will contain a plug (not shown) during operation. Check valve 119 admits lubricant flow from housing 47 if the pressure is sufficiently greater than on the motor facing side. Check valve 125 admits lubricant flow from the motor facing side of motor end adapter 107 if the pressure on the motor facing side of motor end adapter 107 is sufficiently greater than on the pump facing side.

Figure 2B:
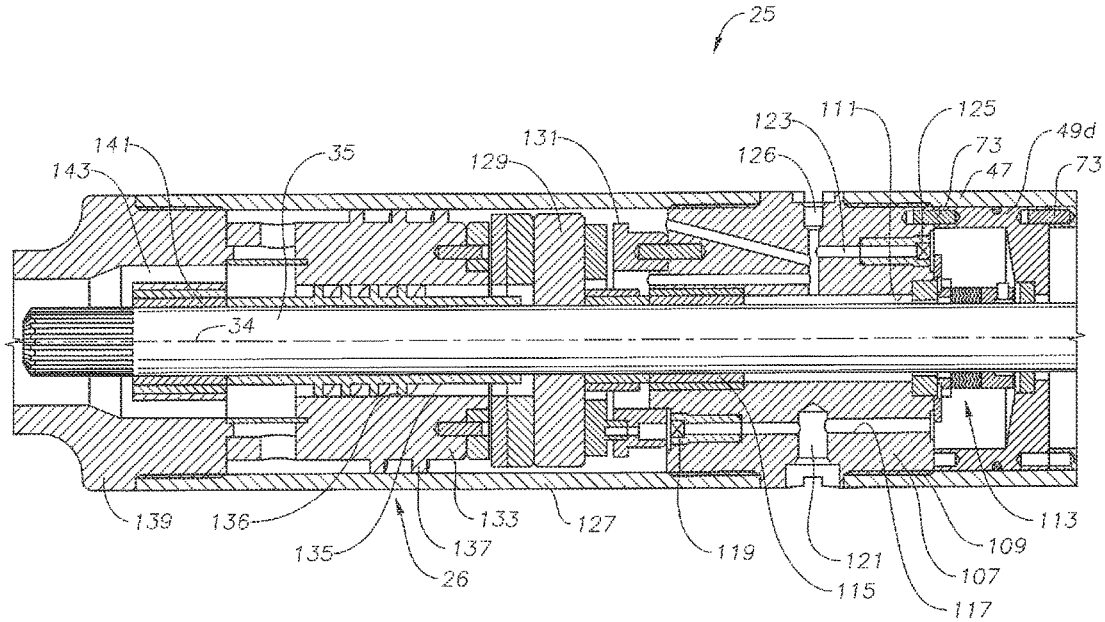

Referring still to FIG. 2*b*, in this example, thrust bearing unit 26 includes a thrust runner housing 127 that secures by threads to motor end adapter 107. Thrust runner housing 127 has a same inner and outer diameter as seal section housing 47, but may have a different length. A thrust runner 129 mounts to shaft 35 for both axial and rotational movement. An upthrust stationary member 131 is located on the motor facing side of motor end adapter 107 for engagement by the pump facing side of runner 129 during upthrust conditions. A downthrust stationary member 133 is located on the motor facing side of runner 129 for engagement by runner 129 during downthrust conditions. One leg of check valve passage 123 leads outward of upthrust stationary member 131 and another inward of upthrust stationary member 131.

Optionally, an inducer 135 mounts to shaft 35 for rotation therewith to circulate lubricant through thrust bearing unit 26 during operation. Inducer 135 rotates with shaft 35 and is located within the central bore of downthrust stationary member 133. Inducer 135 has a helical flight or vane to propel lubricant toward thrust runner 129. The lubricant returns from the spaces around thrust runner 129 through an annular space surrounding downthrust stationary member 133. A helical flight or rib 137 may be located on the outer diameter of downthrust stationary member 133 to cause swirling of the returning lubricant as it flows through the annular space.

A motor adapter 139 secures by threads to a lower end of thrust unit housing 127. Motor adapter 139 couples to motor 27 (FIG. 1) with bolts in this example.

During operation and referring to FIG. 1, motor lubricant will be introduced into equalizer 29, motor 27, thrust unit 26 and seal section 25 before lowering ESP into casing inclined portion 13*b*. Once installed well fluid flows from perforations 15 to pump intake 23 while motor 27 rotates shaft 35 (FIGS. 2A, 2B) to operate pump 21. Pressure equalizer 29 maintains a pressure of motor lubricant in motor 27, thrust bearing unit 26 and seal section 25 approximately the same as the hydrostatic pressure of the well fluid exterior of motor 27. Referring to FIGS. 2A and 2B, lubricant will be located in the spaces between each disc 49 and between each auxiliary seal 75 and adjacent discs 49. The lubricant can flow from the space on one side of each disc 49 to the opposite side through communication ports 67. Lubricant can flow through check valves 101, 103 of each auxiliary valve assembly 75 if the pressure differential is adequate. Main seal 37 may weep in response to well fluids degrading the sealing surface, and well fluid entering housing 47 past main seal 37 can migrate toward motor 27. However, due to the inclination of casing 13*a*, some of the communication ports 67 will be at higher elevations by a few inches than others. The water within the well fluid must rise to a higher elevation to pass through the communication ports 67 in some of the discs 49, then migrate downward to flow through the communication ports 67 in other discs 49. Also, auxiliary seal 81 of each auxiliary seal assembly 75 will tend to block the passage of water toward motor 27. Motor end seal 113 provides a final barrier to well fluid encroachment in motor 27.

While the disclosure has been shown in only one of its forms, it should be apparent to those skilled in the art that it is susceptible to various modifications. For example, the auxiliary seal assembly could be installed in seal sections lacking labyrinth discs and intended for vertical operation.

The invention claimed is:

1. A well fluid submersible pump assembly, comprising:

a plurality of modules, including a pump operatively coupled to a motor and a seal section located between the motor and the pump, the seal section comprising:

a motor end adapter for operatively connecting to the motor;

a pump end adapter for operatively connecting to the pump;

a housing having one end secured to the pump end adapter and another end secured to the motor end adapter, the housing having a longitudinal axis and being in fluid communication with lubricant in the motor via the motor end adapter;

a drive shaft driven by the motor and extending axially through the seal section for driving the pump;

a main seal sealing around the shaft at the pump end adapter, the main seal having an outer side for exposure to well fluid and an inner side in contact with lubricant in the seal section;

first and second labyrinth discs within the housing between the motor end adapter and the pump end adapter, each mounted sealingly around the shaft and having an outer diameter portion that sealingly engages a bore interior surface of the housing, defining a motor lubricant chamber between the discs;

a continuously open communication port extending through each of the discs to communicate motor lubricant in the housing into and out of the chamber, the communication ports being spaced angularly relative to each other to create a serpentine motor lubricant flow path through the chamber;

an auxiliary seal carrier entirely located within the housing in the chamber between the first and second discs, the seal carrier having a bore through which the shaft extends and a cylindrical outer diameter portion, the seal carrier having a maximum outer diameter less than a minimum inner diameter of the housing;

an outer diameter seal that seals between the outer diameter portion of the seal carrier and the bore interior surface of the housing;

a mechanical face seal mounted in the bore of the seal carrier and in engagement with the shaft, the face seal having one side exposed to motor lubricant in the chamber on a pump side of the seal carrier and another side exposed to motor lubricant in the chamber on a motor side of the seal carrier; and check valve means in the seal carrier that allows lubricant flow in the chamber from the pump side to the motor side of the seal carrier if lubricant pressure on the motor side exceeds the lubricant pressure on the pump side by a selected amount, and allows lubricant flow from the motor side to the pump side of the seal carrier if the lubricant pressure on the pump side exceeds the lubricant pressure on the motor side by a selected amount.

2. The pump assembly according to claim 1, wherein the check valve means comprises:

first and second check valve ports extending from the motor side to the pump side of the seal carrier offset from the bore of the seal carrier; and first and second check valves in the first and second check valve ports, respectively.

3. The pump assembly according to claim 2, wherein:

the seal carrier has a central portion extending radially outward from the bore of the seal carrier to the outer diameter portion of the seal carrier;

the outer diameter portion of the seal carrier has a greater axial dimension than any part of the central portion, defining a central cavity on one of the sides of the seal carrier; and the check valve ports extend through the central portion.

4. The pump assembly according to claim 1, further comprising:

an axially extending anti rotation pin in engagement with a hole formed in one of the sides of the seal carrier to prevent rotation of the seal carrier within the housing.

5. The pump assembly according to claim 1, wherein:

the mechanical face seal is located on the pump side of the seal carrier.

6. The pump assembly according to claim 2, wherein:

the mechanical face seal is located on the pump side of the seal carrier; and the seal carrier has a central cavity extending axially from the bore on the motor side of the seal carrier; and the check valve ports extend from the pump side of the seal carrier to the central cavity.

7. The pump assembly according to claim 1, wherein the outer diameter portion of each of the discs has a same axial length as the outer diameter portion of the seal carrier.

8. A well fluid submersible pump assembly, comprising:

a plurality of modules, including a pump operatively coupled to a motor and a seal section located between the motor and the pump, the seal section comprising:

a single piece tubular housing having a central bore extending along a longitudinal axis of the housing;

adapters secured to opposite ends of the housing for operatively securing the housing to the motor and to the pump;

a shaft extending axially through the bore of the housing and through the adapters for driving the pump;

a plurality of labyrinth discs located within the housing between the adapters, each mounted sealingly around the shaft and having an outer diameter portion that sealingly engages a bore interior surface of the housing, defining motor lubricant chambers between the discs;

a continuously open communication port extending through each of the discs to communicate motor lubricant in the housing between the chambers, the communication ports being spaced angularly relative to each other to create a serpentine motor lubricant flow path through the chambers while the pump assembly is operated horizontally;

an auxiliary seal carrier located in the housing in one of the chambers between two of the discs, the seal carrier having a central bore through which the shaft extends and having an outer diameter portion that sealingly engages the bore interior surface;

a pump side check valve in the seal carrier that allows lubricant in said one of the chambers to flow from a pump side of the seal carrier to a motor side of the seal carrier in response to a selected pressure differential;

a motor side check valve in the seal carrier, the motor side check valve configured to allow lubricant in said one of the chambers to flow from the motor side of the seal carrier to the pump side of the seal carrier in response to a selected pressure differential;

a mechanical face seal in said one of the chambers, the mechanical face seal having a stationary member mounted in the bore of the seal carrier and a rotating member in sliding and sealing engagement with the stationary member, the face seal having one side exposed to motor lubricant within said one of the chambers on the motor side of the seal carrier and another side exposed to motor lubricant within the same one of the chambers on the pump side of the seal carrier;

the outer diameter portion of the seal carrier having a side in abutment with a side of the outer diameter portion of said at least one of the discs; and the outer diameter portions of the discs having axial lengths equal to each other and to an axial length of the outer diameter portion of the seal carrier, enabling the auxiliary seal assembly to be selectively installed within the housing in place of one of the discs.

9. The pump assembly according to claim 8, wherein the bore interior surface of the housing from a first one of the discs closest to one of the adapters to a second one of the discs closest to the other of the adapters is smooth and constant in diameter.

10. The pump assembly according to claim 8, further comprising:

an anti rotation pin extending axially from the outer diameter portion of said at least one of the discs to the auxiliary seal carrier, to prevent rotation of the auxiliary seal carrier relative to the housing.

11. The pump assembly according to claim 8, further comprising:

a main seal mounted in the adapter that is opposite the adapter connected to the motor for sealing around the shaft, the main seal having one side configured for contact with well fluid and an opposite side configured for contact with motor lubricant in the housing.

12. The pump assembly according to claim 8, further comprising:

a pressure equalizer mounted to an end of the motor opposite the seal section, the pressure equalizer configured for reducing a pressure difference between well fluid on an exterior of the motor and lubricant within the motor.

13. A well fluid submersible pump assembly, comprising:

a plurality of modules, including a pump operatively coupled to a motor and a seal section located between the motor and the pump, the seal section comprising:

a single piece tubular housing having a central bore extending along a longitudinal axis of the housing;

adapters secured to opposite ends of the housing for operatively securing the housing to the motor and to the pump;

a shaft extending axially through the bore of the housing and through the adapters for driving the pump;

first, second and third labyrinth discs located within the housing between the adapters, each mounted sealingly around the shaft and having an outer diameter portion that sealingly engages a bore interior surface of the housing, defining a first chamber between the first and second discs and a second chamber between the second and third discs;

a continuously open communication port extending through each of the discs to communicate motor lubricant in the housing between the chambers, the communication ports being spaced angularly relative to each other to create a serpentine motor lubricant flow path through the first and second chambers while the pump assembly is operated horizontally;

first and second seal carriers located in the housing in the first and second chambers, respectively, each of the seal carriers having a central bore through which the shaft extends and having an outer diameter portion that sealingly engages the bore interior surface;

a pump side check valve in each of the seal carriers that allows lubricant to flow from a pump side of each of the seal carriers to a motor side of the each of the seal carriers in response to a selected pressure differential;

a motor side check valve in each of the seal carriers that allows lubricant to flow from the motor side of each of the seal carriers to the pump side of each of the seal carriers in response to a selected pressure differential; and first and second mechanical face seals mounted to the first and second seal carriers, respectively, in the first and second chambers, respectively, each of the mechanical face seals having a stationary member and a rotating member for sealing around the shaft.

* * * * *